United States Patent [19]

Watanabe

[11] Patent Number: 4,891,868

[45] Date of Patent: Jan. 9, 1990

[54] EYE FOR A HOOK-AND-EYE FASTENER

[75] Inventor: Hirokazu Watanabe, Kurobe, Japan

[73] Assignee: Yoshida Kogyo K.K., Tokyo, Japan

[21] Appl. No.: 336,118

[22] Filed: Apr. 11, 1989

[30] Foreign Application Priority Data

Apr. 13, 1988 [JP] Japan ..... 63-48835

[51] Int. Cl.[4] ..... A44B 13/00

[52] U.S. Cl. ..... 24/691; 24/698

[58] Field of Search ..... 24/598, 599, 698, 687, 24/688, 689, 690, 691

[56] References Cited

U.S. PATENT DOCUMENTS

| | | | |
|---|---|---|---|
| 2,071,575 | 2/1937 | Reiter | 24/688 |
| 3,120,045 | 2/1964 | Silver et al. | 24/691 |
| 4,001,924 | 1/1977 | Beugtsson | 24/687 |
| 4,539,735 | 9/1985 | Kasai | 24/691 X |
| 4,625,370 | 12/1986 | Fukuroi et al. | 24/599 |

FOREIGN PATENT DOCUMENTS 31-13766 3/1956 Japan .

*Primary Examiner*—James R. Brittain

*Attorney, Agent, or Firm*—Hill, Van Santen, Steadman & Simpson

[57] ABSTRACT

A female component of a hook-and-eye fastener is assembled from an eye body and an eyelet. The eye body of a hollow configuration having opposite end openings into which a hook body of a male component is inserted to engage the eye body of the female component, which body is provided with, in its bottom wall: upward-and-inward sloping portions in the opposite end openings; a recessed portion interposed between the sloping portions; and an aperture through which is passed a distal end part of a hollow shank portion of the eyelet. In assembling of the female component, the distal end part of the shank portion of the eyelet is staked so as to be plastically deformed into an annular curled edge abutting against an inner surface of the bottom wall of the eye body. Since the annular curled edge of the shank portion of the eyelet is entirely received in the recessed portion of the bottom wall of the eye body, it is possible to reduce the overall height of the eye body, which leads to reduction of the overall height of the female component, whereby the fastener is improved in appearance and texture.

4 Claims, 3 Drawing Sheets

EYE FOR A HOOK-AND-EYE FASTENER

BACKGROUND OF THE INVENTION

1. Field of the Invention

The present invention relates to a hook-and-eye fastener which is employed in dresses, suits and other garments, and consists of: a male component; and a female component for receiving a part of the male component therein in a slidable manner in fastening action thereof, and more particularly to a female component of the hook-and-eye fastener, the female component being provided with an improved eye body which enables the female component to be considerably low in its overall height and to be fixed to a garment fabric without causing any pucker of the garment fabric, whereby the fastener is remarkably improved in its appearance and texture.

2. Description of the Prior Art

Heretofore, it has been known to provide a hook-and-eye fastener of the type disclosed in Japanese Utility Model Publication No. 56-13766.

As shown in FIG. 1, the above conventional hook-and-eye fastener consists of: a male component 3 assembled from a hook body 1 and a capped eyelet 2; and a female component 6 assembled from an eye body 4 and a simple eyelet 5. In assembling of the fastener, the hook body 1 of the male component 3 of the fastener is fixedly mounted on the back of a garment fabric 7 by means of the capped eyelet 2, while the eye body 4 of the female component 6 of the same fastener is fixedly mounted on the face of another garment fabric 8 by means of the simple eyelet 5. In fastening action of the thus assembled fastener, a tongue portion of the hook body 1 of the male component 3 of the fastener is so oriented as to be aligned with a hook-insertion opening of the eye body 4 of the female component 6 of the same fastener, and moved in the closing direction of the fastener so that the hooking-in engagement of the hook body 1 of the male component 3 of the fastener in the eye body 4 of the female component 6 of the same fastener is established in a sliding manner.

In such conventional hook-and-eye fastener, as shown in FIG. 1, the eye body 4 of the female component 6 of the fastener assumes a substantially flat square-shaped tubular form consisting of, in cross section: a base mounting plate section 4*a*; a top engaging plate section 4*b* lying substantially parallel to the base mounting plate section 4*a*; and intermediate opposite plate sections 4*c* substantially perpendicular to the base mounting plate section 4*a* and the top engaging plate section 4*b*, which intermediate opposite plate sections 4*c* extend between opposite ends of the base mounting plate section 4*a* and the top engaging plate section 4*b*. The base mounting plate section 4*a* of the eye body 4 is provided with a struck-out central portion having an aperture 9 for receiving the eyelet 5 therein. In assembling of the female component 6 of the fastener, a front-end portion 5*a* of a hollow shank of the eyelet 5 passes through the aperture 9 of the struck-out central portion of the eye body 4, and staked around a peripheral edge portion 9*a* of the through-hole 9 inside the eye body 4 so that the front-end portion 5*a* of the eyelet 5 is plastically deformed into an annular curled edge abutting against an inner surface of the struck-out central portion of the eye body 4 around the aperture 9, whereby the female component 6 of the fastener is fixedly mounted on the face of the garment fabric 8. At this time, an outer peripheral edge portion 9*b* of the aperture 9 of the eye body 4 of the female component 6 is fixed to the garment fabric 8 with a good bite so that the eye body 4 of the female component 6 is prevented from rotating relative to the garment fabric 8.

However, in the eye body 4 of the female component 6 of the conventional fastener, the struck-out central portion such as the outer peripheral edge portion 9*b* of the aperture 9 of the eye body 4 projects outward from a plane of the base mounting plate 4*a* to intensely compress the garment fabric 8 around the aperture 9, which causes some pucker of the garment fabric 8 around the female component 6 of the conventional fastener. In addition, by the presence of such pucker, the overall height of the female component 6 of the conventional fastener is disadvantageously increased so that the conventional fastener is considerably impaired in its appearance and texture.

SUMMARY OF THE INVENTION

It is an object of the present invention to provide a female component of a hook-and-eye fastener employed in dresses, suits and other garments, the female component being provided with an improved eye body which enables the female component to be considerably low in its overall height and to be fixed to a garment fabric without causing any pucker of the garment fabric, whereby the fastener is remarkably improved in its appearance and texture.

The above object of the present invention is accomplished by providing:

In a female component of a hook-and-eye fastener comprising: a male component provided with a hook body fixedly mounted on a garment fabric., and a female component provided with an eye body which is fixedly mounted on another garment fabric by means of an eyelet, a part of said hook body of said male component being inserted into said eye body of said female component so as to engage said female component in fastening operation of said fastener, the improvement wherein:

said eye body of said female component is formed into a hollow member having its opposite end portions open to form a pair of hook-insertion openings, said hollow member being constructed of: a base mounting plate section having an eyelet-insertion aperture in its central portion, into which eyelet-insertion aperture is inserted an eyelet for fixing said eye body of said female component to said garment fabric; a top engaging plate section which is spaced apart from said base mounting plate section while disposed parallel to the latter; and opposite plate sections through which opposite end portions of said base mounting plate section are connected with those of said top engaging plate section; and said base mounting plate section of said eye body of said female component is provided with: a pair of garment-fabric receiving cavity portions in its outer surface abutting against said garment fabric, between which garment-fabric receiving cavity portions is interposed said eyelet-insertion aperture; a pair of upward-and-inward sloping portions in its inner surface defining partially said hook-insertion openings, between which upward-and-inward sloping portions is interposed said eyelet-insertion aperture; and a recessed portion in its inner surface, said recessed portion being interposed between said upward-and-inward sloping portions while positioned above said eyelet-insertion aperture so that said upward-and-inward sloping portions form struck-out rising portions adjacent to said eyelet-insertion aperture inside said eye body.

The female component of the hook-and-eye fastener of the present invention is advantageous in the following points:

Since, due to the presence of the recessed portion of the base mounting plate section entirely receiving the staked front-end portion or annular curled edge of the eyelet therein, the outer surface of the base mounting plate section of the eye body of the female component of the present invention lies in a substantially flat plane abutting against the garment fabric in contrast with that of the base mounting plate section projecting outward, there is no fear that the garment fabric on which the fastener is fixedly mounted suffers from pucker produced around the fastener.

In addition, since the outer surface of the base mounting plate section of the eye body of the female component of the present invention is sufficiently wide and substantially flat, it is possible to fixedly mount the eye body on the garment fabric in a stable manner. In other words, it is possible to prevent the garment fabric from being damaged during assembling and use of the fastener.

As described above, since the outer surface of the base mounting plate section of the eye body of the female component of the present invention substantially lies in a flat plane abutting against the garment fabric, it is possible to reduce the overall height of the female component of the present invention relative to that of the female component of the conventional fastener, which improves the fastener of the present invention in appearance and texture.

In addition, in assembling of the eye body of the female component of the present invention, the eye body is fixed to the garment fabric by means of the eyelet with a good bite due to the presence of the concave portions formed in the outer surface of the base mounting plate section, the garment fabric being inserted into the concave portions so as to be press-fitted thereto. Consequently, there is no fear that the thus assembled female component of the present invention rotates relative to the garment fabric.

Further, in the hook-and-eye fastener of the present invention, the upward-and-inward sloping portions provided in the base mounting plate section of the eye body of the female component of the fastener makes it easy to insert the tongue portion of the hook body of the male component of the fastener into the eye body, and produces substantially no looseness between the hook body of the male component and the eye body of the female component after insertion of the tongue portion of the hook body into the opening of the eye body.

Additional objects and features of the present invention will become apparent from the following description of the preferred embodiment of the invention, which will be made with reference to the accompanying drawings in which like reference numerals denote like parts.

DESCRIPTION OF THE PREFERRED EMBODIMENT

Now, an embodiment of a hook-and-eye fastener of the present invention will be hereinbelow described in detail with reference to the accompanying drawings.

Figure 3:
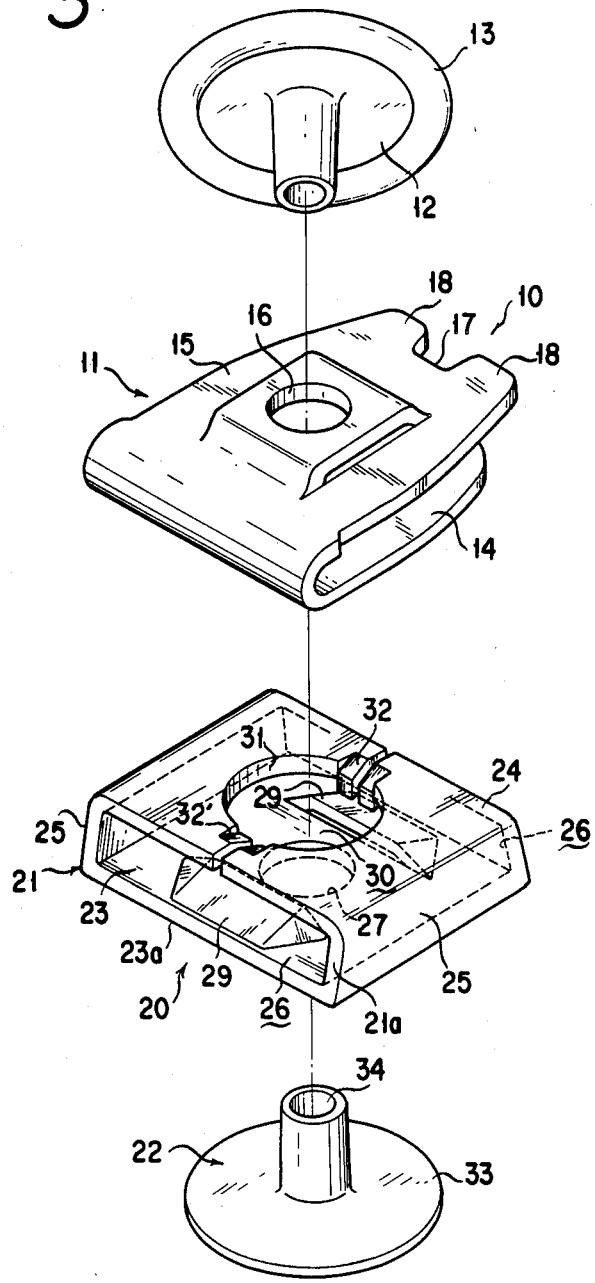
FIG. 3 is an exploded view of the embodiment of the hook-and-eye fastener of the present invention shown in FIG. 2.

As is clear from FIG. 3, the hook-and-eye fastener of the present invention is constructed of a male component 10 and a female component 20. The male component 10 is assembled from a hook body 11 and a capped eyelet 12 provided with an decorative cap 13. On the other hand, the female component 20 is assembled from an eye body 21 and a simple eyelet 22.

Figure 1:
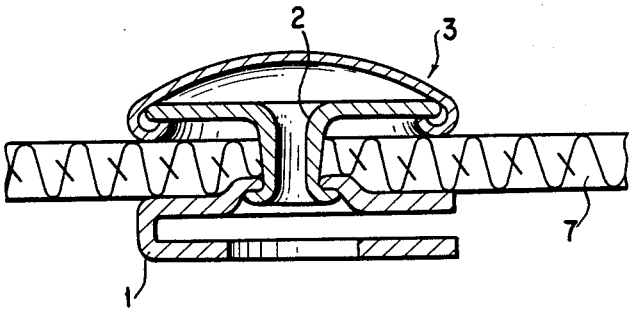
FIG. 1 PRIOR ART
FIG. 1 is a longitudinal sectional view of a conventional hook-and-eye fastener constructed of a male component and a female component, in a condition of disengagement.
Figure 1:
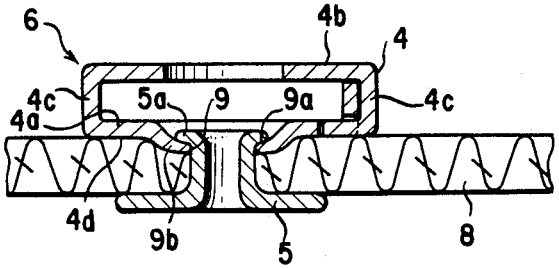
FIG. 1 PRIOR ART
Figure 2:
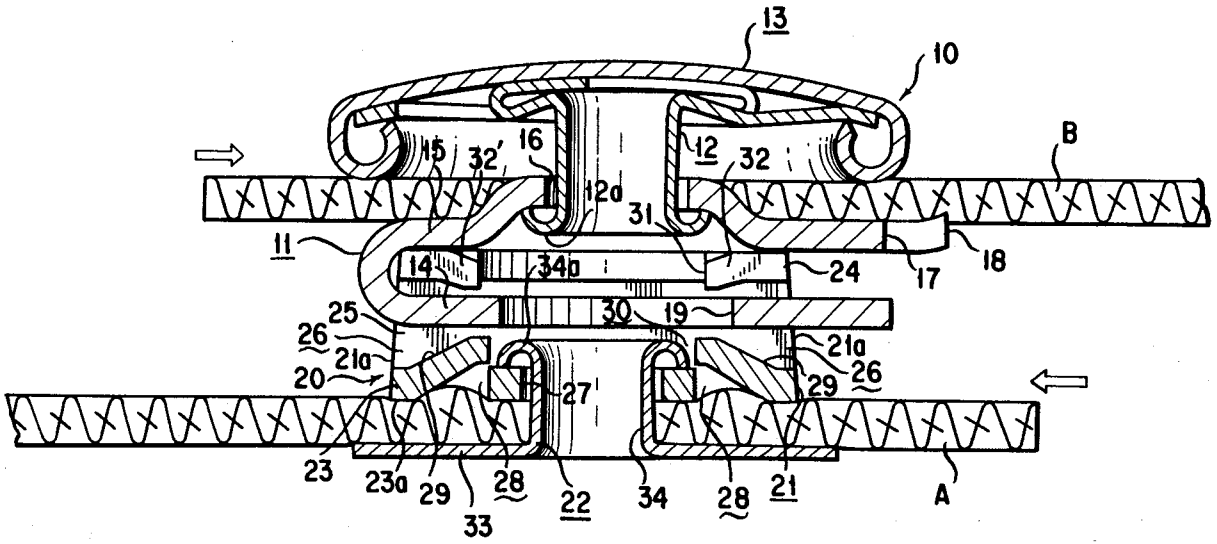
FIG. 2 is a longitudinal sectional view of an embodiment of a hook-and-eye fastener of the present invention in a condition of engagement.

The eye body 21 of the female component 20 is formed into a substantially flattened rectangular hollow member comprising: a base mounting plate section 23 abutting against a garment fabric on which the female component 20 is fixedly mounted; a top engaging plate section 24 which is spaced apart from the base mounting plate section 23 while disposed substantially parallel to the base mounting plate section 23; and opposite end plate sections 25 which are perpendicularly interposed between the base mounting plate section 23 and the top engaging plate section 24 to connect corresponding opposite end portions of these plate sections 23, 24 to each other. The eye body 21 has its opposite ends open to form a pair of hook-insertion openings 26 into which a tongue portion 14 of the hook body 11 of the male body 10 is inserted. In FIG. 2, the hook-insertion openings 26 of the eye body 21 lie in planes extending upward to incline toward each other so that the eye body 21 assumes a substantially trapezoidal configuration in FIG. 2, thereby enabling the eye body 21 to exert stability. The base mounting plate section 23 of the eye body 21 is provided with an eyelet-insertion aperture 27 in its central portion. In an inner surface of the base mounting plate section 23 of the eye body 21, the eyelet-insertion aperture 27 is interposed between a pair of upward-and-inward sloping portions 29 of the base mounting plate section 23. An outer surfaces **23*a* of each of the sloping portions 29 of the base mounting plate section 23 defines a concave portion 28 for receiving the garment fabric "A" therein after completion of assembling of the female component 20. In addition, a recessed portion 30 is provided inside the eye body 21 above the central eyelet-insertion aperture 27 and between the sloping portions 29 of the base mounting plate section 23**.

In a central portion of the top engaging plate section 24 of the eye body 21 is formed a large-diameter aperture 31 which is concentrically arranged with the eyelet-insertion aperture 27 of the base mounting plate section 23 of the eye body 21. Pairs of diametrically opposed tab portions 32, 32' are formed in a peripheral edge portion of the large-diameter aperture 31 of the top engaging plate section 24. As is clear from FIG. 3, these pairs of tab portions 32, 32' extend from the top engaging plate section 24 downward and radially inward to form downward-and-inward sloping portions 32, 32'.

The eyelet 22 of the female component 20 is provided with a base flange portion 33 and a hollow cylindrical shank portion 34. In assembling of the female component 20, the hollow shank portion 34 of the eyelet 22 having pierced the face of the garment fabric "A" is inserted into the eyelet-insertion aperture 27 of the eye body 21. After that, a distal end part of the hollow shank portion 34 of the eyelet 22 is staked so as to be plastically deformed into an annular curled edge 34a abutting against the bottom wall of the recessed portion 30 of the base mounting plate section 23 of the eye body 21, the bottom wall of the recessed portion 30 being adjacent a peripheral edge defining the eyelet-insertion aperture 27 of the base mounting plate section 23, so that the eye body 21 of the female component 20 is fixedly mounted on the face of the garment fabric "A". As is clear from FIG. 2, at this time, the annular curled edge 34a of the hollow shank portion 34 of the eyelet 22 is so positioned in the recessed portion 30 of the eye body 21 as to be slightly below in level the top of the upward-and-inward sloping portion 29 of the base mounting plate section 23 of the eye body 21. On the other hand, the hook body 11 of the male component 10 of the fastener assumes a substantially U-shaped form provided with a bight portion and a pair of leg portions depending from the bight portion, one of the leg portions providing the tongue portion 14 horizontally insertable into and removable from the hook-insertion opening 26 of the eye body 21 of the female component 20. The tongue portion 14 is spaced apart from the other leg portion forming a back mounting portion 15 substantially by a distance on the order of the thickness of the top engaging plate section 24 of the eye body 21 of the female component 20. In a central portion of the back mounting portion 15 of the hook body 11 is formed an eyelet-insertion aperture 16 in which is inserted the capped eyelet 12 of the male component 10. In assembling of the male component 10, a hollow cylindrical shank portion of the capped eyelet 12 having pierced the back of the garment fabric "B" is inserted into the aperture 16 of the hook body 11, and then staked so that a distal end part of the hollow shank portion of the capped eyelet 12 is plastically deformed into an annular curled edge abutting against an inner surface of the back mounting portion 15 of the hook body 11, whereby the hook body 11 of the male component 10 is fixedly mounted on the back of the garment fabric "B".

In a free end of the back mounting portion 15 of the hook body 11 is formed a notch portion 17 which is interposed between a pair of protruding portions 18 which are slightly bent upward in FIG. 2 to facilitate insertion of the tongue portion 14 of the hook body 11 into the hook-insertion opening 26 cf the eye body 21. On the other hand, an aperture 19 is formed in the tongue portion 14 of the hook body 11 so as to be concentrically disposed with the eyelet-insertion aperture 16 of the back mounting portion 15 of the hook body 11.

In fastening operation of the hook-and-eye fastener of the present invention, the male component 10 and the female component 20 are moved in directions shown by arrows in FIG. 2, respectively, so that the tongue portion 14 of the hook body 11 of the male component 10 is inserted into the hook-insertion opening 26 of the eye body 21 of the female component 20, whereby the male component 10 is joined with the female component 20.

In insertion of the tongue portion 14 of the hook body 11 into the hook-insertion opening 26 of the eye body 1, the tongue portion 14 of the hook body 11 is guided by the upward-and-inward sloping portion 29 of the base mounting plate section 23 of the eye body 21 to facilitate a smooth insertion of the tongue portion 14 of the hook body 11 into the hook-insertion opening 26 of the eye body 21. In addition, as shown in FIG. 2, after completion of such insertion, since the tongue portion 14 of the hook body 11 is interposed between the upward-and-inward sloping portions 29 and the downward-and-inward sloping portions 32, 32', there is substantially no fear that a disadvantageous looseness is produced therebetween.

After completion of such insertion, when the male component 10 is moved in a direction counter to the direction shown by the arrow in FIG. 2 by accident so as to be removed from the female component 20, the downward-and-inward sloping portions 32' of the eye body 21 of the female component 20 is brought into contact with the peripheral edge of the aperture 19 of the tongue portion 14 of the male component 10 to make it difficult that the hook body 11 of the male component 10 drops out of the eye body 21 of the female component 20 by accident. This is one of effects inherent in the present invention.

What is claimed is:

1. In a female component of a hook-and-eye fastener including: a male component provided with a hook body fixedly mounted on a garment fabric; and a female component provided with an eye body which is fixedly mounted on another garment fabric by means of an eyelet, a part of said hook body of said male component being inserted into said eye body of said female component so as to be engaged with said female component in fastening operation of said fastener, the improvement wherein:

said eye body of said female component is formed into a hollow member having its opposite end portions open to form a pair of hook-insertion openings, said hollow member comprising: a base substantially planar mounting plate section having an eyelet-insertion aperture in its central portion, into which eyelet-insertion aperture is inserted an eyelet for fixing said eye body of said female component to said garment fabric; a top engaging plate section which is spaced apart from said base mounting plate section while disposed parallel to the latter; and opposite end plate sections through which opposite end portions of said base mounting plate section are connected with those of said top engaging plate section; and wherein:

said base mounting plate section of said eye body of said female component is provided with embossed rising portions formed inside said eye body at opposite sides of said eyelet insertion aperture and are positioned adjacent to said hook-insertion openings, respectively, whereby:

a pair of garment-fabric receiving cavity portions are formed in its outer surface abutting against said garment fabric, between which garment-fabric receiving cavity portions is interposed said eyelet-insertion aperture;

a pair of upward-and-inward sloping portions are formed in its inner surface extending inside said eye body beyond said substantially planar base mounting plate section defining partially said hook-insertion openings, between which upward-and-inward sloping portions is interposed said eyelet-insertion aperture; and a recessed portion is formed in its inner surface, said recessed portion being interposed between said upward-and-inward sloping portions while positioned above said eyelet-insertion aperture.

2. A female component of a hook-and-eye fastener as set forth in claim 1, wherein said hollow member is formed into a substantially rectangular configuration.

3. A female component of a hook-and-eye fastener as set forth in claim 1, wherein said eye body of said female component assumes a substantially trapezoidal configuration.

4. A female component of a hook-and-eye fastener as set forth in claim 1, wherein said top engaging plate section has an aperture of a large diameter than said eyelet insertion aperture formed in the central portion of said base mounting plate section, said larger diameter aperture being formed coaxially with said eyelet-insertion aperture, and a pair of downwardly sloping tab portions each embossedly formed at a peripheral edge portion of said larger diameter aperture where is opposite to each of said embossed rising portions of said base mounting plate section in the vertical direction.

* * * * *